United States Patent [19]

Noguchi

[11] 3,999,612

[45] Dec. 28, 1976

[54] WATER-POWERED FIRE-FIGHTING FOAM GENERATOR

[75] Inventor: Morihisa Noguchi, Menuma, Japan

[73] Assignee: Nohmi Bosai Kogyo Kabushiki Kaisha, Tokyo, Japan

[22] Filed: Dec. 8, 1975

[21] Appl. No.: 638,632

[52] U.S. Cl. ..... 169/14; 239/214.15

[51] Int. Cl.[2] ..... A62C 35/00

[58] Field of Search ..... 169/14, 15; 239/214.13, 239/214.15, 498, 251, 432

[56] References Cited

UNITED STATES PATENTS

| | | | |
|---|---|---|---|
| 2,005,639 | 6/1935 | Schroeder et al. | 239/214.15 |
| 3,428,131 | 2/1969 | Winslow | 169/15 |
| 3,441,086 | 4/1969 | Barnes | 169/15 |
| 3,559,741 | 2/1971 | Levy | 169/15 |

FOREIGN PATENTS OR APPLICATIONS

| | | | |
|---|---|---|---|
| 1,238,761 | 7/1971 | United Kingdom | 169/14 |

*Primary Examiner*—John J. Love
*Attorney, Agent, or Firm*—Pierce, Scheffler & Parker

[57] ABSTRACT

An apparatus for generating high expansion foam. The disclosed apparatus includes an elongated housing having an inlet and an outlet and a perforated member extending across its free passage area. A fan is positioned in the housing and drivingly rotated by impulse nozzles supplied with pressurized liquid foam solution. The nozzles are arranged tangentially to the rotational axis of the fan, in a plane normal to the axis. A deflector is positioned around the nozzles so as to direct jet spray of the liquid foam solution partially toward the central portion of the perforated member and partly toward the outer edge portion of the perforated member to provide a relatively uniform wetting of the perforated means. The deflector further provides means for permitting all the nozzles to be directed tangentially to the rotational axis in design and to be mounted at the greatest possible distance from the shaft to provide the largest moment arm in order to increase percentage of the power available in the water supply.

4 Claims, 2 Drawing Figures

WATER-POWERED FIRE-FIGHTING FOAM GENERATOR

BACKGROUND OF THE INVENTION

This invention relates to fire-fighting foam generating apparatus and more particularly to such apparatus which includes an elongated housing having an inlet and outlet, a net member extending across its passage area, a fan to propel air through the housing, and a plurality of reaction nozzles mounted on a fan rotor for spraying foam producing solution onto the net member and for driving the fan rotor by the reaction forces thus produced to pump air outwardly through the net member to generate the foam.

It has heretofore been hnown in the art that the efficiency of a water powdered apparatus depends upon the percentage of the power available in the water supply which is utilized to produce the air flow through the apparatus, and upon the uniformity of the distribution over the surface of the net member, of both this air flow and the solution used by the apparatus.

It has also been known in the art that when both air flow and the solution are evenly distributed over the surface of the net, the foam produced at all points on the net will contain the same ratio of the solution to air. The quantities of air and solution can then be selected so that all of the foam produced will have the proper ratio of solution to air for maximum effectiveness in fire-fighting.

In order to achieve maximum utilization of the available water power, all of the nozzles are required to be mounted at the greatest possible distance from the shaft to provide the largest moment arm.

On the other hand, the radial distance at which the reaction nozzles are positioned from the axis of the shaft must also be a compromise. If the nozzles are positioned at a substantial radial distance from the shaft to increase the power extracted from the water, then the solution issuing therefrom is directed toward the outer edge of the net to an even greater extent as would defeat the purpose of uniformity. If the nozzles are positioned close to the axis of the shaft to increase the distribution of this solution over the net, then the amount of power extracted from the water is reduced.

In addition, the distribution of the solution over the net is seriously hampered by the centrifugal force acting upon the solution issuing from the reaction nozzles because of the rotation of these nozzles. This centrifugal force tends to throw the solution outwardly thus further concentrating the solution at the outer edge of the net.

The above mentioned two optimum conditions cannot coexist in a workable unit of the prior art type. This is now a problem and solution is demanded.

SUMMARY OF THE INVENTION

A principal object of the present invention therefore is to provide a foam generator characterized by mounting all of the reaction nozzles at the greater possible distance from the rotational axis of the fan motor to provide the largest moment arm for driving the fan while preventing the spray jets from the nozzles from being greatly influenced by the centrifugal force.

The foregoing object and others are attained according to at least one aspect of the present invention through the provision of regularly slotted deflector surrounding the reaction nozzles so as to change course of part of the spray toward the central portion of the net with the other part of the spray permitted to disperse outwardly of the deflector toward the outer edge of the net. Thus uniformity of the spray is attained on the net member surface.

Thus in the disclosed embodiment, there is provided an elongated tubular housing having an inlet end and an outlet end, fan means of the air plane propeller type which rotates on an axial shaft to produce an axial flow and positioned within said housing between the inlet end and outlet end to cause air to flow from the inlet end to the outlet end, a net member covering the free passage area of the housing downstream of the fan means in the direction of air flow, a plurality of reaction jet spray nozzles positioned within the housing and connected with a source of foam generating liquid solution under pressure, all of the nozzles being directed tangentially to the rotational axis of the fan means and mounted on the fan means in integral therewith to co-rotate to achieve maximum utilization of the available water power. A deflector means is further provided in the housing around the nozzles non-rotatably. The deflector extends outwardly and forwardly of the rotational shaft of the fan means to partly direct the spray jet of the foam solution in a direction parallel to the rotational axis of the fan and partly direct the spray jet in a direction toward the central portion of the net member so that uniformity of both the solution and the air flow on the net.

This invention will be described and illustrated with reference to the apparatus having a cross-sectionally rectangular housing, but is not limited to such housing and a cross-sectionally circular housing may be substituted for the rectangular housing without departing from the invention.

DESCRIPTION OF A PREFERRED EMBODIMENT

Figure 1:
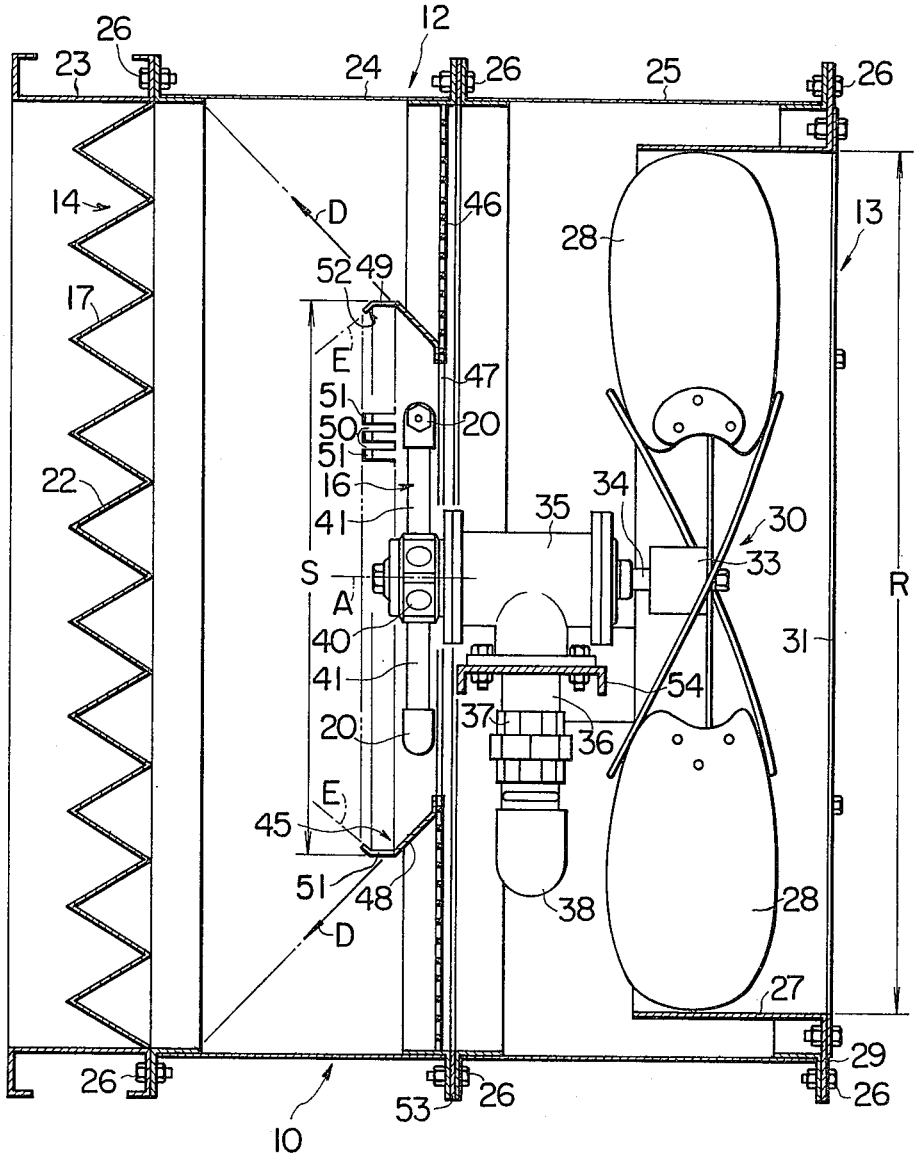
FIG. 1 is a longitudinal sectional view of a foam generator in accordance with the present invention.
Figure 2:
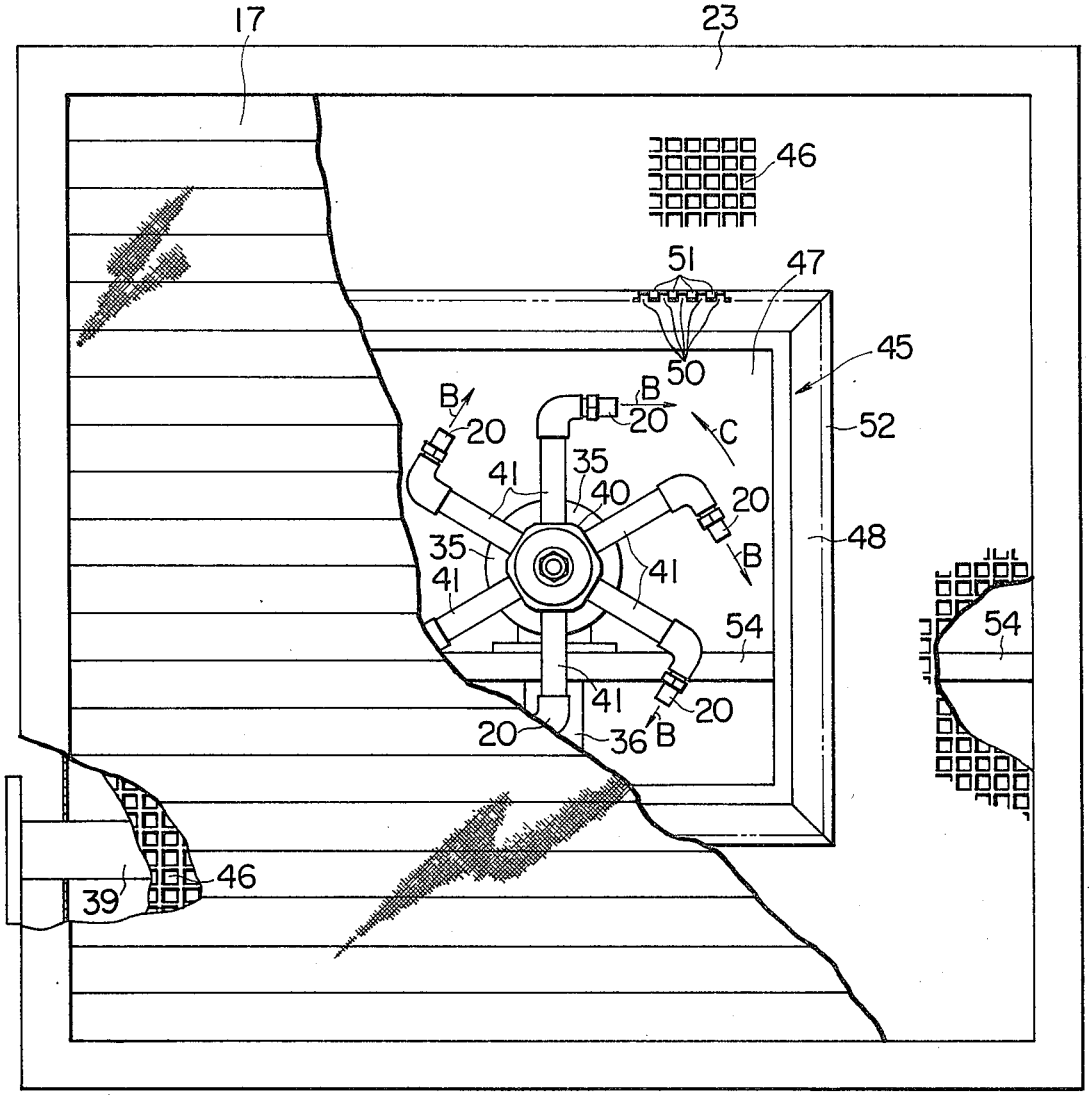
FIG. 2 is a side view of the apparatus of FIG. 1 viewed from the left of FIG. 1.

Referring now to the drawings wherein the showings are for the purpose of illustrating preferred embodiment of the invention only and not for the purpose of limiting the same, in FIGS. 1 and 2, a foam generator 10 is shown to include a tubular housing 12 rectangular in cross section and having an air intake 13 and outlet 14. The fan mounted within the housing 12 is driven in accordance with the invention by a reaction jet motor broadly indicated by the numeral 16 and described more in detail hereinafter. A perforated net member or sieve 17 extends across the free passage area of the housing 12 adjacent the outlet 14. A liquid spray of foam solution is introduced by nozzles 20 which is then borne by the velocity of the air stream created by the fan against the sieve 17. The member of foam-forming perforations 22 in the sieve 17 is greatly increased by virtue of the zig-zag pattern. It has been proven in the art that the bubbles formed, and consequently the volume of foam produced, can be increased, to a degree, by increasing the velocity of the air flow and/or the perforated surface area of the sieve 17. Further it has been known in the art that the upper limit on the velocity of the air stream is determined in dependency upon various factors such as the surface tension of the foam solution, which affects its ability to bridge across the foam-forming perforations 22, and the size of the perforations.

The housing 12 is constructed in three main sections 23 to 25 which are made as individual units joined by mechanical fastener such as bolts 26. Within section 25 is a fan casing 27 cylindrical in cross section and closely surrounding the blades 28 of fan 30, the purpose of which will be obvious to those who skilled in the art. At one end of the casing 27 is a flange 29 which is bolted to the section 25. Foam is produced on the sieve 17 by forcing air through the perforations which have been sprayed with the foam solution from nozzles 20. A guarding net 31 is fastened to the casing 27 in order to safeguard the fan from any dust or dirt.

Referring now particularly to FIG. 1, the fan 30 includes hub 33 journaled on a shaft 34 mounted axially of the housing 12 upon a fan support bearing 35 which is in turn supported by a supporting frame 54. The shaft 34 is partly hollow and the hollow portion (not shown) is fluidly connected to a line 36 communicating through a joint member 37, elbow 38 and conduit pipe 39 (FIG. 2) with a source of generally comprises mostly water with a detergent chemical added of any well-known type in the proper proportions to insure stable high expansion foam. The hollow portion of shaft 34 is provided with in its wall a suitable number of ports (not shown) connecting to a chamber in the bearing 35 so that the hollow shaft 34 may be fluidly connected to the line 36. The fan shaft 34 is provided at the other end another hub 40 which supports a plurality of radially extending pipes 41 each fluidly connecting with the hollow shaft 34 and circumferentially spaced. Each pipe 41 carries a nozzle 20 to form the reaction jet motor.

In accordance with the invention, each nozzle 20 points at right angle to the axis of fan rotation A (FIG. 1). Under pressure from line 36 and conduit 39, each nozzle introduces a spray jet of foam solution indicated at B (FIG. 2). Since the fan hub 40 which supports the nozzles 20 is free to rotate, the combined thrust from each of the nozzles 20 imparts rotation to the fan 30 in the direction of arrow C in FIG. 2. Thus the reaction jet angulation of the nozzles 20 with respect to fan axis A is such that as above stated with the result that all of the nozzles are directed tangentially to the rotational shaft of fan 30, and maximum utilization of the available water power would be therefore achieved. The greater the length of pipes 41, the greater will be the moment arm of the reaction motor 16 for driving the fan 30.

In accordance with the invention, a deflector 45 is provided within the section 24 with an aim that a uniformity may be achieved in distributing the air flow and the solution over the surface of the net 17. Both the air flow and the solution are required to be evenly distributed over the surface of the net 17, so that foam produced at all points on the net may contain the same ratio of solution to air. The quantities of air and solution can be selected in design so that all of the foam produced will have the proper ratio of solution to air for maximum affectiveness in fire-fighting. The deflector 45 is of rectangular shape in cross section somewhat like a picture frame so that each of the four sides is in parallel relation to the corresponding wall of the quadrilateral section housing 12. A rectifying member 46 is mounted within the section 24 across the housing by means of welding or mechanical fastener such as bolts. The rectifying member 46 is uniformly perforated to permit the flow of air in rectified condition therethrough. The rectifying member further has a central rectangular opening 47 of identical size with that of the deflector 45 so that the rectifying member 46 may support the deflector so as to permit the flow of air through the rectangular opening 47.

As seen in FIG. 1, the deflector 45 has a tapered portion 48 of increasing cross-sectional area toward the down-wind side of the rectifying member 46, the purpose of which will be explained hereinafter. The deflector 45 further extends toward the down-wind side to form a constant cross-section portion 49. The portion 49 is slotted at regular intervals in comb-like form with each resulting tooth 51 inwardly bent in order to form a reversely tapered portion 52 (FIG. 1) as a unit, the purpose of which will also be explained hereinafter.

The numeral 53 shows a gasket or seal member for fluid-tightly connecting the sections 24 and 25 one another.

In operation, the apparatus 10 could be installed within an opening of a building so that the inlet 13 is on the outside and the outlet 14 on the inside of the building. Under pressure in line 36, the fan 30 is rotated by the reaction motor 16 which also introduces the foam solution spray wetting the down-stream sieve 17. The solution flows from the line 36 into each of the nozzles 20 and is sprayed from all of the nozzles in a direction tangential to the rotor 16 as shown in FIG. 2.

The flow of solution issuing from the nozzles 20 develops a reaction thrust which drives the fan 30 in the direction of the arrow C shown in FIG. 2. The solution issuing from the nozzles also impinges upon the inner surface of the tapered portion 48 of the deflector 45 to be guided by the portion 48 and advanced to the slotted and constant area portion 49 due to the side thrust developed. The solution is then divided into two parts by the slotted portion 49. One part of the solution still flows through the slots 50 without changing the direction of stream as shown by the arrow D, while the other part of the solution is deflected by the teeth 51 and flows in the direction as shown as at arrow E. Such angulations of the tapered portion 48 and inwardly bent portion of each tooth 51 are given in a manner such that uniformity of the foam solution is achieved all over the net member 17.

It should be noted that all the nozzles are in an imaginary plane normal to the rotational axis of the fan, which plane intersects the tapered portion 48 with the center line therein, so that each spray jet of the solution accurately impinges upon the portion 48. Thus, the solution issuing from the nozzles 20 uniformly wets the entire surface of the net 17 as the air flows.

The rotation of the motor 16 of the fan 30 draws air through the inlet opening 13 and propels this air toward the outlet 14. Part of air flows through outside of the deflector 45 while the other part of air stream flows through inside of the deflector.

The type of the fan 30, i.e., a fan of the air plane propeller type which rotates on an axial shaft tends to produce greater air flow near the tips of the blades than near the axis of rotation. This deficiency has proven in the art to further affect the stream of air of non-uniformity on the net. Such tendency is overcome by selecting a proper diametrical size R of the fan 30 relative to the size of deflector so uniform stream of air is achieved at the down-wind side of the deflector. In other words, the uniformity of air flow is dependent upon the relative sizes of the fan and deflector.

The discrepancy between the rectangular cross sectional shape of the housing 12 and circular rotational cross sectional shape of the housing 12 and circular rotational plane of the fan 30 is small enough to permit neglecting it in achieving the uniformity of air flow. Although the housing and the deflector are shown and described as being in a rectangular form in cross section, it is envisaged that these parts could be in a circular form in cross section with a similar diametrical size to that of the circular rotational plane of the fan.

In order to achieve maximum utilization of the available water power, all the nozzles are first required to be mounted on the rotor at the greater possible distance from the rotational axis to provide the largest moment arm, and secondarily required to be directed along the tangential direction, i.e., perpendicularly to the arm 41 in the imaginary plane in which lie all the arm 41.

In this event, and further in accordance with the invention, such angulation and such distance of each nozzle 20 is given as above mentioned without any fear of a great influence by the centrifugal action of the spray jet of the solution, which action is overcome by the slotted deflector to an extent in which the desired uniformity of the solution is ensured on the net member 17.

What is claimed is:

1. An apparatus for producing fire-fighting foam, comprising an elongated tubular housing having an inlet end and an outlet end, fan means of the airplane propeller type which rotates on an axial shaft to produce an axial air flow and positioned within said housing between said inlet end and said outlet end to cause air to flow from said inlet end to said outlet end, a net member covering the free passage area of said housing downstream of said fan means in the direction of air flow, a plurality of jet spray nozzles positioned within said housing and connected with a source of foam generating liquid solution under pressure, all of the nozzles being directed tangentially to the rotational axis of said fan means and mounted on said fan means in integral therewith to co-rotate to achieve maximum utilization of the available water power, a deflector means surrounding said nozzles and non-rotatably mounted within said housing, said deflector further extending outwardly and forwardly of said housing, said deflector having a tapered portion of increasing cross-sectional area toward the down-wind side of the fan means and a constant cross-section portion extending from the tapered portion toward the down-wind side and being slotted to form a series of teeth at regular intervals, said teeth being inwardly and convergently bent toward the central portion of the net, to direct a part of the spray jet of foam solution in a direction parallel to the rotational axis while the other part of the spray jet in a different direction convergently toward the central portion of the net whereby the solution is prevented from being greatly influenced by the centrifugal action and uniformity of air and the solution on the net is ensured.

2. An apparatus for producing fire-fighting foam as defined in claim 1 wherein said nozzles are spaced radially and circumferentially of the axis of rotation of said fan means.

3. An apparatus for producing fire-fighting foam is defined in claim 1 wherein the rotatably mounted nozzles are carried on elongated hollow arms directly connected to said fan means.

4. An apparatus for producing fire-fighting foam as defined in claim 1 wherein the fan means includes a hollow rotatable shaft, a plurality of fan blades radially extending from the hollow shaft, a hub portion at one end of the hollow shaft, said hollow arms radially extending from the hub portion and fluidly connected with the hollow shaft, a stationary bearing member to support the hollow shaft rotatably and to connect fluidly the hollow shaft and a line means extending from a source of the solution and water under pressure whereby spray jet of the solution is issued for forming a reaction rotor for the fan to drive.

* * * * *